US007991619B2

(12) United States Patent
Chaudhari et al.

(10) Patent No.: US 7,991,619 B2
(45) **Date of Patent: *Aug. 2, 2011**

(54) SYSTEM AND METHOD USING BLIND CHANGE DETECTION FOR AUDIO SEGMENTATION

(75) Inventors: Upendra V. Chaudhari, Briarcliff Manor, NY (US); Mohamed Kamal Omar, Ossining, NY (US); Ganesh N. Ramaswamy, Mohegan Lake, NY (US)

(73) Assignee: International Business Machines Corporation, Armonk, NY (US)

( * ) Notice: Subject to any disclaimer, the term of this patent is extended or adjusted under 35 U.S.C. 154(b) by 236 days.

This patent is subject to a terminal disclaimer.

(21) Appl. No.: 12/142,343

(22) Filed: Jun. 19, 2008

(65) Prior Publication Data

US 2008/0255854 A1 Oct. 16, 2008

Related U.S. Application Data

(63) Continuation of application No. 11/206,621, filed on Aug. 18, 2005, now abandoned.

(60) Provisional application No. 60/663,079, filed on Mar. 18, 2005.

(51) Int. Cl.
*G10L 21/00* (2006.01)

(52) U.S. Cl. ..... 704/278; 704/252; 704/253

(58) Field of Classification Search ..... 704/278, 704/252, 253

See application file for complete search history.

(56) References Cited

U.S. PATENT DOCUMENTS

| | | | | |
|---|---|---|---|---|
| 5,251,263 | A * | 10/1993 | Andrea et al. | 381/71.6 |
| 5,924,066 | A * | 7/1999 | Kundu | 704/232 |
| 6,421,645 | B1 * | 7/2002 | Beigi et al. | 704/272 |
| 6,529,902 | B1 * | 3/2003 | Kanevsky et al. | 1/1 |
| 7,143,353 | B2 * | 11/2006 | McGee et al. | 715/723 |
| 7,243,062 | B2 * | 7/2007 | Wark | 704/214 |
| 7,295,970 | B1 * | 11/2007 | Gorin et al. | 704/221 |

OTHER PUBLICATIONS

"Detection or Abrupt Changes—Theory and Application", M. Basseville, and I. Nikiforov, Prentice-Hall, Apr. 1993.

"An Empirical Comparison of Voting Classification Algorithms: Bagging, Boosting, and Variants", by Eric Bauer, and Ron Kohavi, in Machine Learning, vol. 36, No. 1-2, pp. 105-139, Jul. 1999.

* cited by examiner

*Primary Examiner* — Jakieda R Jackson

(74) *Attorney, Agent, or Firm* — Scully, Scott, Murphy & Presser, P.C.; Anne V. Dougherty, Esq.

(57) ABSTRACT

A system, method and computer program product for performing blind change detection audio segmentation that combines hypothesized boundaries from several segmentation algorithms to achieve the final segmentation of the audio stream. Automatic segmentation of the audio streams according to the system and method of the invention may be used for many applications like speech recognition, speaker recognition, audio data mining, online audio indexing, and information retrieval systems, where the actual boundaries of the audio segments are required.

20 Claims, 3 Drawing Sheets

SYSTEM AND METHOD USING BLIND CHANGE DETECTION FOR AUDIO SEGMENTATION

CROSS-REFERENCE TO RELATED APPLICATIONS

The present application is a continuation application of U.S. Ser. No. 11/206,621, filed Aug. 18, 2005; and relates to and claims the benefit of U.S. Provisional Patent Application Ser. No. 60/663,079 filed Mar. 18, 2005, the entire contents and disclosure of which is incorporated by reference herein.

STATEMENT REGARDING FEDERALLY SPONSORED RESEARCH OR DEVELOPMENT

This invention was made with Government support under contract number H98230-04-3-0001 awarded by the Distillery Phase II Program. The Government has certain rights in this invention

BACKGROUND OF THE INVENTION

1. Field of the Invention

The present invention relates generally to the field of audio data processing systems and methods, and, more particularly, to a novel system and method for performing blind change detection audio segmentation.

2. Discussion of the Prior Art

Many audio resources like broadcast news contain different kinds of audio signals like speech, music, noise, and different environmental and channel conditions. The performance of many applications based on these streams like speech recognition and audio indexing degrades significantly due to the presence of the irrelevant portions of the audio stream. Therefore segmenting the data to homogeneous portions according to type (speech, noise, music, etc.), speaker identity, environmental conditions, and channel conditions has become an important preprocessing step before using them. The previous approaches for automatic segmentation of audio data can be classified into two categories: informed and blind. Informed approaches include both decoder-based and model-based algorithms. In decoder-based approaches, the input audio stream is first decoded using speech and silence models; then the desired segments can be produced by using the silence locations generated by the decoder. In model-based approaches, different models are built to represent the different acoustic classes expected in the stream and the input audio stream can be classified by maximum likelihood selection and then locations of change in the acoustic class are identified as segmental boundaries. In both cases, models trained on the data representing all acoustic classes of interest are used in the automatic segmentation. The informed automatic segmentation is limited to applications where enough amount of training data is available for building the acoustic models. It can not generalize to unseen acoustic conditions in the training data. Also approaches based solely on speech and silence models mainly detect silence locations that are not necessarily corresponding to boundaries between different acoustic segments. We will focus on blind automatic segmentation techniques which do not suffer from these limitations and therefore serve a wider range of applications.

Blind change detection avoids the requirements of the informed approach by trying to build models of the observations in a neighborhood of a candidate point under the two hypothesis of change and no change and using a criterion based on the log likelihood ratio of these two models for automatic segmentation of the acoustic data. Most of the previous approaches had the goal of providing an input to a speech recognition, or a speaker adaptation system. Therefore they provided the evaluation of their systems based on comparisons of the word error rates achieved by using the automatic and the manual segmentation not the accuracy of the generated boundaries using the automatic segmentation. Exceptions of this trend include when the main focus is data indexing.

In many applications like on-line audio indexing and information retrieval, the goal of the automatic segmentation algorithm is to detect the changes in the input audio stream and to keep the number of false alarms as low as possible. Unfortunately all of the current techniques for automatic blind segmentation like using the Kullback-Liebler distance, the generalized likelihood ratio distance, or the Bayesian Information Criterion (BIC) try to optimize an objective function that is not directly related to minimizing the missing probability for a given false alarm rate. If the missing probability is defined as the probability of not detecting a change within a reasonable period of time of a valid change in the stream, then minimizing the missing probability is equivalent to minimizing the duration between the detected change and the actual change, namely the detection time.

Known solutions of this problem like using the BIC criterion are not accurate enough and have robustness problems due to employing a single criterion that is not directly related to minimizing the missing probability for a given false alarm rate and comparing this criterion to a threshold.

Thus, it would be highly desirable to provide a novel approach for solving the automatic audio segmentation problems described herein with respect to the prior art.

It would be highly desirable to provide a novel approach for solving the automatic audio segmentation problem that combines the results of several segmentation algorithms to achieve better and more robust segmentation.

SUMMARY OF THE INVENTION

It is an object of the present invention to provide a comprehensive system, method and computer program product that enables blind change detection audio segmentation.

In one aspect, the system and method combines hypothesized boundaries from several segmentation algorithms to achieve the final segmentation of the audio stream. More particularly, a methodology is implemented that combines the output of at least two blind change detection audio segmentation systems to generate a final segmentation. Particularly, the system and method combines at least two approaches for change detection using different statistical modeling of the data, and optimizes at least two different criteria to generate an automatic segmentation of the audio stream.

Thus, according to the invention, there is provided a system, method and computer program product for blind change detection of audio segments. The method comprises the following:

providing an input audio stream to be segmented;

applying at least two change detection audio segmentation processes to said input audio stream and obtaining candidate change points from each;

combining said candidate change points of each said applied processes for audio segmentation change detection; and, removing invalid candidate change points to thereby optimize audio segmentation change points of the audio stream.

According to the invention, the system and method searches for a proper segmentation of a given audio signal such that each resulting segment is homogeneous and belongs to one of the different acoustic classes like speech, noise, and music and, to a single speaker and a single channel. At least two algorithms, known in the art, are implemented and assumptions made to make the estimation of the segmentation points efficient. Three algorithms contemplated for use include: the BIC, CuSum (cumulative sum), and the CDF comparison (Kolmogorov-Smirnov's test) for automatic segmentation of the audio data.

As part of the audio segmentation process, the method further comprises recording a start time for each remaining change point in the audio stream, i.e., for each segment, determining whether a candidate change point exists, and recording a corresponding start time.

Advantageously, the system and method for providing automatic segmentation of the audio streams according to the invention, is used for many applications like speech recognition, speaker recognition, audio data mining, online audio indexing, and information retrieval systems, where the actual boundaries of the audio segments are required.

BRIEF DESCRIPTION OF THE DRAWINGS

The objects, features and advantages of the present invention will become apparent to one skilled in the art, in view of the following detailed description taken in combination with the attached drawings, in which.

DETAILED DESCRIPTION OF PREFERRED EMBODIMENT

Figure 1A:
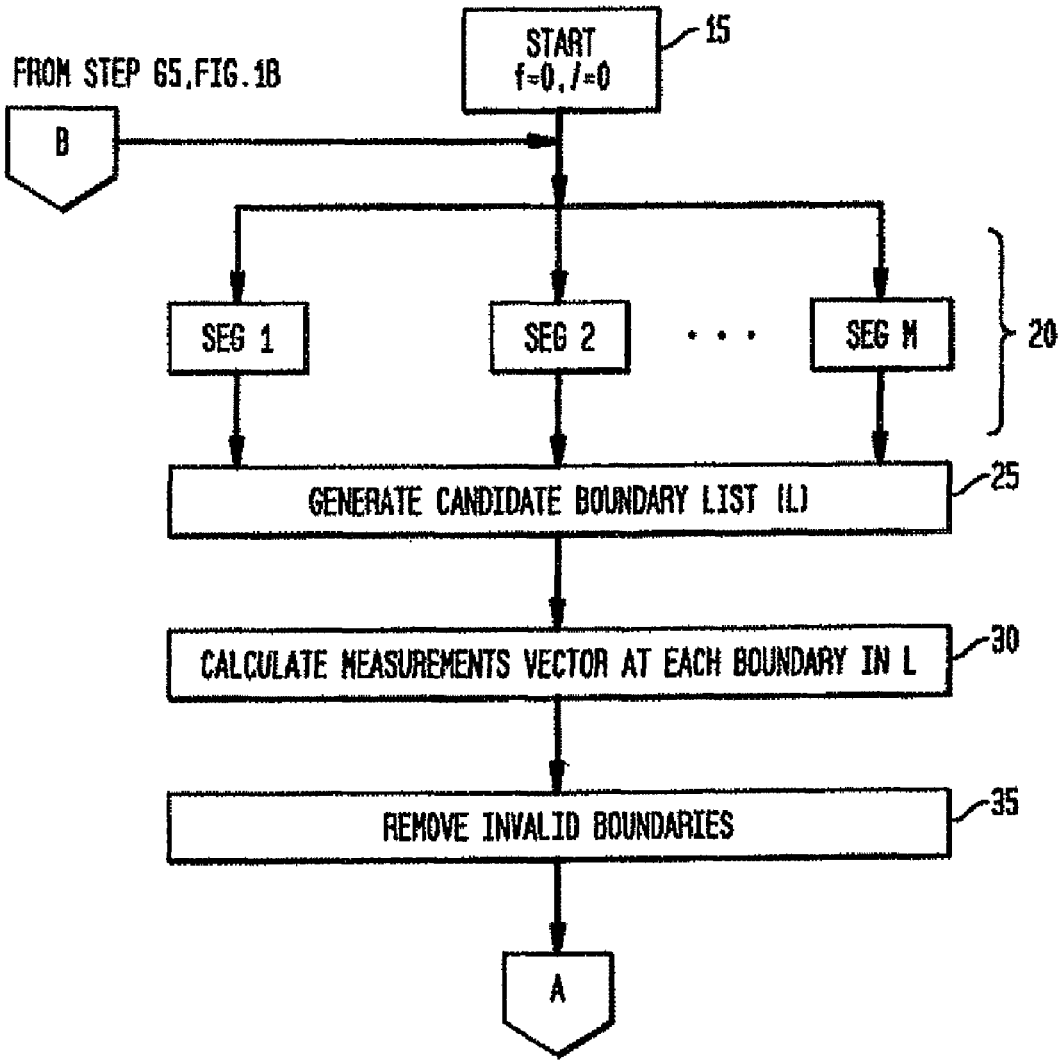
FIGS. 1A and 1B provide a generic flow chart depicting the methodology for blind detection audio segmentation according to the invention.

The present invention is directed to a system and method that combines various approaches for audio segmentation change detection using different statistical modeling of the data and optimizes different criteria to generate an automatic segmentation of the audio stream.

While an example embodiment described herein utilizes three (3) automatic change detection audio segmentation algorithms, it is understood that other algorithms providing for automatic segmentation of the audio data may be used in addition to or as alternates of the three algorithms described herein. While it is understood that the invention contemplates use of at least two algorithms, three (3) algorithms employed according to the present invention are now described:

A. Change Detection Using the CuSum Algorithm

Under the assumption that the sequence of the log likelihood ratios, $\{l_i\}_{i=1}^{n}$ is an i.i.d process, the CuSum algorithm is optimal in the sense of minimizing detection time for a given false alarm rate. This assumption is valid for many interesting processes like some random processes that are modeled by Markov chains or some autoregressive processes. In the CuSum algorithm, the likelihood ratio of the conditional PDFs of the observations under both the hypothesis $H_1$ of change for time $r \leqq n$ and the hypothesis $H_0$ is estimated, then the maximum of the sum of the log likelihood ratio of a given sequence of observations is compared to a threshold to determine whether a boundary exists between two segments of the observation sequence. Given n observations, a comparison is made as in equation (1) as follows:

$$c_n = \max_r \sum_{k=r}^{n} l_k, \tag{1}$$

where $l_k$ is the log likelihood ratio of the observation k to a threshold $\lambda$.

The CuSum algorithm assumes that the conditional PDFs of the observations under both the hypothesis $H_1$ of change for time $r \leqq n$ and the hypothesis $H_0$ of no change (i.e. $r \geqq n$) are known. In most automatic segmentation applications, this is not true. Therefore, a two-Gaussian mixture is trained using the n observations in the given sequence. The two Gaussian components are initialized such that the mean of one of them corresponds to the mean of few observations in the beginning of the sequence of observations and the mean of the other corresponds to the mean of few observations in the end of the observations sequence. The automatic segmentation using the CuSum algorithm is then reduced to a binary hypothesis testing problem. The two hypothesis of this problem are $$H_0: z_{r^*}, \ldots, z_n \sim N(\mu_0, \Sigma_0),$$

and $$H_1: z_{r^*}, \ldots, z_n \sim N(\mu_1, \Sigma_1)$$

where $$r^* = \operatorname{argmax}_r \sum_{k=r}^{n} l_k,$$

where $l_k$ is the log likelihood ratio estimated using the two Gaussian components $N(\mu_0, \Sigma_0)$ and $N(\mu_1, \Sigma_1)$.

B. Change Detection Using the BIC Algorithm

The Bayesian information criterion is based on the log likelihood ratio of two models representing the two hypothesis of having two-class or one-class observation sequence. It adds a penalty term to account for the difference in the number of parameters of the two models. The parameters of both models are estimated using the maximum likelihood criterion. Given n observations, the Bayesian information criterion BIC approach performs a comparison as in equation (2) as follows:

$$b_n = \sum_{k=1}^{n} l_k - \frac{1}{2}(d_1 - d_2)\log(nM), \tag{2}$$

where $d_1$ and $d_2$ are the number of parameters of the two models, and M is the dimension of the observation vector.

Thus, the conditional PDF of the observations under the hypothesis $H_1$ of change consists of two Gaussian PDFs. Both Gaussian PDFs are trained using maximum likelihood estimation. One of them is trained using the observations before the hypothesized boundary and the other is trained using observations after it. The conditional PDF of the observations under the hypothesis $H_0$ of no change is modeled with a single Gaussian PDF trained using maximum likelihood estimation from using all the n observations. Detecting a change at time r using the BIC algorithm is then reduced to a binary hypothesis testing problem. The two hypothesis of this $$H_0: z_1, \ldots, z_n \sim N(\mu_0, \Sigma_0),$$

and $$H_1: z_1, \ldots Z_{r-1} \sim N(\mu_1, \Sigma_1);$$

$$z_r, \ldots, z_n \sim N(\mu_2, \Sigma_2);$$

where $N(\mu_0,\Sigma_0)$ is the Gaussian model trained using all the n observations and $N(\mu_1,\Sigma_1)$ is trained using the first r observations and $N(\mu_2,\Sigma_2)$ is trained using the last n-r observations. Since the model of the conditional PDF under the hypothesis $H_1$ of change depends on the location of the change, reestimation of the model parameters is required for each new hypothesized boundary within the sequence of observations of length n. This problem is avoided in the CuSum algorithm implementation, as in this case both models are independent of the location of the hypothesized boundary.

C. Change Detection Using the Kolmogorov-Smirnov's Test

The Kolmogorov-Smirnov's test is a nonparametric test of change in the input data. It compares the maximum of the difference of the empirical CDFs of the data before and after the hypothesized change point to a threshold to determine whether this point is a valid boundary point between two distinct classes. In other words, to test the validity of a boundary at observation k, the test performs a comparison as in equation (3) as follows:

$$S_n = \sup_z |F_k(z) - G_{n-k}(z)|, \tag{3}$$

where $$F_k(z) = \frac{1}{k}\sum_{j=1}^{k} \Theta(z - z_j), \tag{4}$$

$$G_{n-k}(z) = \frac{1}{n-k}\sum_{j=k+1}^{n} \Theta(z - z_j), \tag{5}$$

and $\Theta(.)$ is the unit step function, to a threshold $\alpha$.

The Kolmogorov-Smirnov's test was designed for one-dimensional observations. To generalize for observation vectors of dimension M, it is assumed that the elements of the observation vector are statistically independent and replace the criterion of the Kolmogorov-Smirnov's test with the following criterion according to equation (6) as follows.

$$S_n = \sup_m \sup_s |F_k^m(z_s^m) - G_{n-k}^m(z_s^m)|, \tag{6}$$

where $$F_k^m(z_s^m) = \frac{1}{k}\sum_{j=1}^{k} \Theta(z_s^m - z_j^m), \tag{7}$$

and $$G_{n-k}^m(z^m) = \frac{1}{n-k}\sum_{j=k+1}^{n} \Theta(z_s^m - z_j^m), \tag{8}$$

for m=1, . . . , M, and the range of values of each dimension is quantized to fixed number of bins, $\{z_s^m\}_{s=1}^{S}$ to be used in calculating the empirical CDFs.

Since the three approaches of BIC, cumulative sum, CDF comparison for automatic segmentation of the audio data use different criteria and different modeling of the conditional PDFs of the observations under both hypothesis of valid change or no change. It is reasonable to expect these algorithms to employ complementary information for automatic change detection and therefore combining the three approaches can improve the overall performance and robustness of the automatic change detection system. For purposes of description, the three algorithms described herein are implemented for the automatic blind change detection scheme for audio segmentation according to one embodiment of the invention. It is understood that in alternate embodiments, two of the three automatic audio segmentation algorithms may be used for automatic change detection according to the principles described herein; furthermore, approaches of more than three audio segmentation algorithms (e.g., a number of "M" algorithms) may be combined for automatic change detection without departing from the scope of the invention. For example, observation sequences resulting from application of change detection using Kullback-Liebler measure, non-linear volume-preserving maps, support vector machines, independent component analysis are examples of such change detection algorithms that may be employed.

Figure 1B:
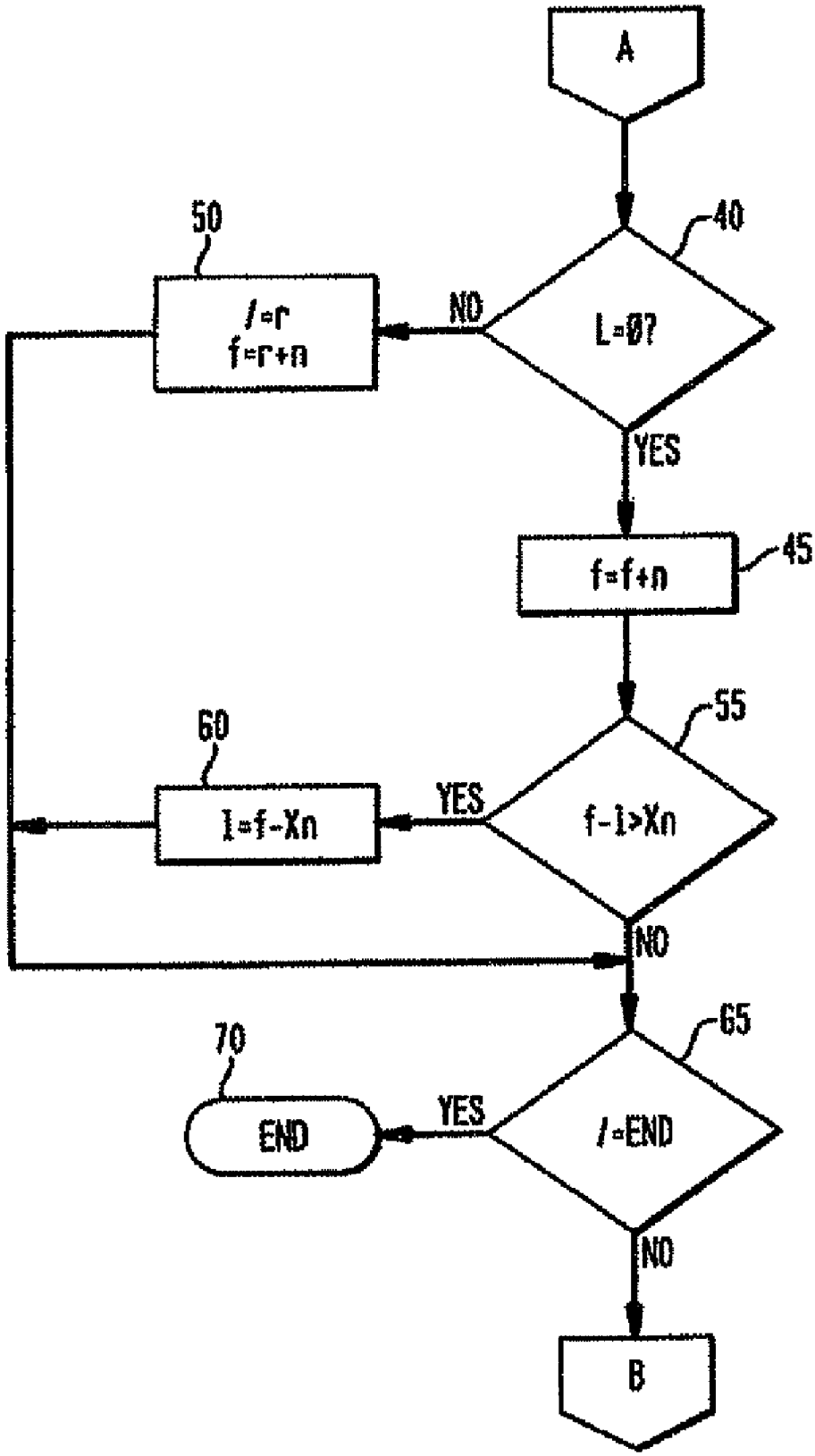

FIGS. 1A and 1B are flow charts describing the steps of the blind change detection algorithm according to the invention. In FIG. 1A, step 15 represents the step of initializing the first observation index "f" with zero (i.e., time interval output of each algorithm employed f=0) and the start time "l" is initialized with zero (i.e., l=0). To combine the three approaches (or up to a number of "M" approaches), in the embodiment described herein, each of the approaches is applied separately to the same audio source to generate a set of potential change points. Thus, as indicated at step 20, the three algorithms (or up to a number of "M" algorithms) processing the same audio source data each provide a respective sequence of observations, with each sequence labeled Seg_1, Seg_2, . . . , Seg_M comprising a respective plurality of time intervals or segments. In an exemplary embodiment, the duration of each segment ranges from about 3-4 seconds, for example. In the description provided in greater detail herein, the duration of a time segment is denoted by the variable "$n_0$" as it is understood that the segment duration may differ based on the criterion and the algorithm implemented. As known to skilled artisans, a re-labeling of the time index may be performed to have a unified scale for all algorithms.

Continuing in FIG. 1A, at step 25, there is performed the step of detecting if there is a change using the three (or more) algorithms for the input sequence of observations.

To accomplish this, as indicated at step 25, a list of the candidate points are generated from the union of the output of the three (or more) algorithms, referred to as a candidate boundary list (L). Then, the values of the three (or more) measures used in the three (or more) algorithms for detection of the change are evaluated at every point of the three sets. This comprises calculating the values of the measurements of the three (or more) algorithms at every point of the candidate list as indicated at step 30.

Although not shown in the Figures, based on either a voting scheme or a likelihood ratio test of two models trained on the values of the three (or more) measurements of manually segmented data (i.e., change points labeled manually) near and far from a valid change respectively, the set of valid change points are selected from the collection of the three sets (i.e., invalid boundaries are removed). That is, as shown at step 35, FIG. 1A, there is depicted the step of removing the invalid changes from the list (L) using a voting scheme or a likelihood ratio test. Teachings of a voting scheme that may be implemented according to the invention may be found in the reference entitled "An Empirical Comparison of Voting Classification Algorithms: Bagging, Boosting, and Variants", by Eric Bauer, and Ron Kohavi, in Machine Learning, Vol. 36, No. 1-2, pp. 105-139, July 1999. Teachings of a likelihood ratio testing that may be implemented according to the invention may be found in the reference entitled "Detection or Abrupt Changes—Theory and Application", M. Basseville, and I. Nikiforov, Prentice-Hall, April 1993.

Continuing to step 40, FIG. 1B, there is depicted the step of determining in the first time segment produced by each of the three (or more) algorithms employed, whether the union of candidate change points detected in the like segments comprises the empty set, i.e., candidate list L=0 in the like segment processed by each algorithm (1, . . . ,M). If the candidate change points detected comprises the empty set, then the observation sequence or time interval is advanced to the next time segment interval, i.e., $f=f+n_0$ as depicted at step 45, and the process proceeds to step 55 where a determination is made as to whether an amount of time has elapsed without encountering a candidate point (i.e., boundary). That is, a determination is made as to whether the difference between the start time l and the current observation sequence time f is greater than a multiple of time segment durations, i.e., $f-l>Xn_0$, where X is a coefficient representing a multiple of time segments durations, e.g., X=3 in the example embodiment described. If the difference between the current observation sequence time f and the start time l is not greater than a multiple of time segment durations, then the process proceeds to step 65 where a determination is made as to whether the last observation sequence (time segment) has been reached. If the end of the audio stream has been reached, the process ends as indicated at step 70; otherwise, the next time segment of the observation sequence provided by each algorithm is processed by returning to step 20, FIG. 1A, for generating the next Candidate Boundary List (L) in the next segment produced by the three approaches and the process repeats.

Returning to step 55, if it is determined that the difference between the current observation sequence time f and the start time l is greater than a multiple of time segment durations, then a new start time is calculated as performed at step 60 according to:

$$l=f-Xn_0$$

Thus, for example, if the time commensurate with 3 time segments has elapsed without hitting a candidate boundary, then the process will result in execution of step 60 to set the next current starting time l to the next observation sequence f offset by the quantity $Xn_0$; i.e., set $l=f-Xn_0$. Thereafter, the process proceeds to step 65 to determine if the end of the audio stream (last time segment) has been reached. If the end of the audio stream has been reached, the process ends as indicated at step 70; otherwise, the next time segment of the observation sequence provided by each algorithm is processed by returning to step 20, FIG. 1A, for generating the next Candidate Boundary List (L) in the next segment produced by the three approaches and the process repeats.

Returning to step 40, if a candidate change point is detected in the current segment, then the following calculations are performed:

set l=r; and $$f=r+n_0;$$

where r is the location (in time) of the last change in the candidate list i.e., the time when a valid change point is encountered in an audio segment). Thus, according to these calculations the observation sequence f and the starting time l is changed after detection of a change point and the process proceeds to step 65 to determine if the end of the audio stream (last time segment) has been reached. If the end of the audio stream has been reached, the process ends as indicated at step 70; otherwise, the next time segment of the observation sequence provided by each algorithm is processed by returning to step 20, FIG. 1A, for generating the next Candidate Boundary List (L) in the next segment produced by the at least two algorithms for the input sequence.

As will be appreciated by one of skill in the art, embodiments of the present invention may be provided as methods, systems, or computer program products. Accordingly, the present invention may take the form of an entirely hardware embodiment, an entirely software embodiment or an embodiment combining software and hardware aspects. Furthermore, the present invention may take the form of a computer program product, which is embodied on one or more computer-usable storage media (including, but not limited to, disk storage, CD-ROM, optical storage, and so forth) having computer-usable program code embodied therein.

Figure 2:
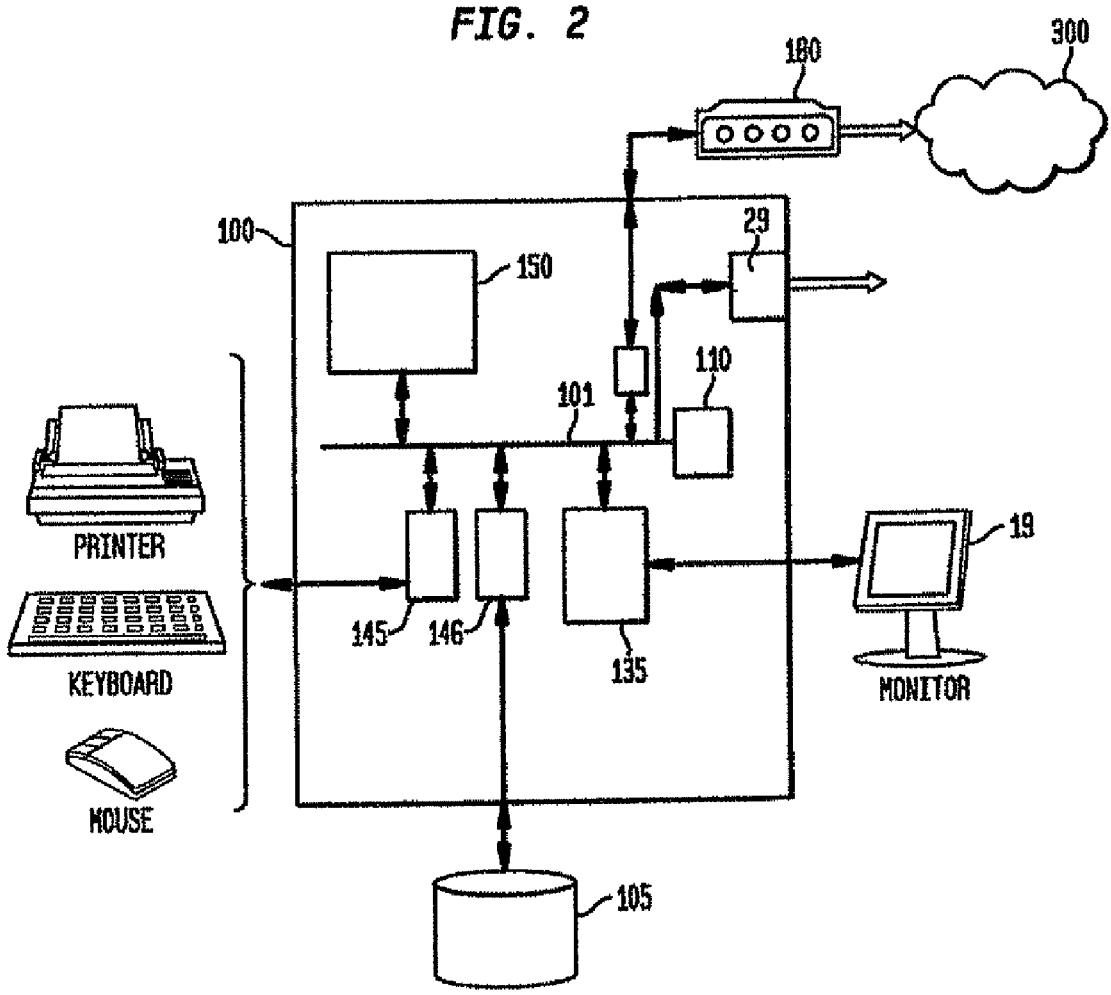
FIG. 2 depicts an example computer system architecture 100 in which the system and method of the invention is implemented.

Thus, as shown in FIG. 2, the system for implementing the present invention may be provided in a computer workstation 100 having an input for receiving audio data from a source, and a device for storing that data including but not limited to: a memory storage device or database including the audio source files (audio data). Each workstation comprises a computer system 100, including one or more processors or processing units 110, a system memory 150, and a bus 101 that connects various system components together. For instance, the bus 101 connects the processor 110 to the system memory 150. The bus 101 can be implemented using any kind of bus structure or combination of bus structures, including a memory bus or memory controller, a peripheral bus, an accelerated graphics port, and a processor or local bus using any of a variety of bus architectures such as ISA bus, an Enhanced ISA (EISA) bus, and a Peripheral Component Interconnects (PCI) bus or like bus device. Additionally, the computer system 100 includes one or more monitors 19 and, operator input devices such as a keyboard, and a pointing device (e.g., a "mouse") for entering commands and information into computer, data storage devices, and implements an operating system such as Linux, various Unix, Macintosh, MS Windows OS, or others.

The computing system 100 additionally includes: computer readable media, including a variety of types of volatile and non-volatile media, each of which can be removable or non-removable. For example, system memory 150 includes computer readable media in the form of volatile memory, such as random access memory (RAM), and non-volatile memory, such as read only memory (ROM). The ROM may include an input/output system (BIOS) that contains the basic routines that help to transfer information between elements within computer device 100, such as during start-up. The RAM component typically contains data and/or program modules in a form that can be quickly accessed by processing unit. Other kinds of computer readable media 105 for storing program data and/or audio data to be segmented according to the invention include a hard disk drive (not shown) for reading from and writing to a non-removable, non-volatile magnetic media, a magnetic disk drive for reading from and writing to a removable, non-volatile magnetic disk (e.g., a "floppy disk"), and an optical disk drive for reading from and/or writing to a removable, non-volatile optical disk such as a CD-ROM, DVD-ROM, or other optical media. Any audio data storage media 10 including hard disk drive, magnetic disk drive, and optical disk drive would be connected to the system bus 101 by one or more data media interfaces 146. Alternatively, the hard disk drive, magnetic disk drive, and optical disk drive can be connected to the system bus 101 by a SCSI interface (not shown), or other coupling mechanism. Although not shown, the computer 100 can include other types of computer readable media. Generally, the above-identified computer readable media provide non-volatile storage of computer readable instructions, data structures, program modules, and other data for use by computer 100. For instance, the readable media can store the operating system (O/S), one or more application programs, such as the audio segmentation editing software applications, and/or other program modules and program data for enabling blind change detection for audio segmentation according to the invention. Input/output interfaces 145, 146 are provided that couple the input devices and data storage devices to the processing unit 110. More generally, input devices can be coupled to the computer 100 through any kind of interface and bus structures, such as a parallel port, serial port, universal serial bus (USB) port, etc. The computer environment 100 also includes the display device 19 and a video adapter card 135 that couples the display device 19 to the bus 101. In addition to the display device 19, the computer environment 100 can include other output peripheral devices, such as speakers (not shown), a printer, etc. I/O interfaces 145 are used to couple these other output devices to the computer 100.

Computing system 100 is further adapted to operate in a networked environment using logical connections to one or more other computers that may include all of the features discussed above with respect to computer device 100, or some subset thereof. It is understood that any type of network can be used to couple the computer system 100 with server device 20, such as a local area network (LAN), or a wide area network (WAN) 300 (such as the Internet). When implemented in a LAN networking environment, the computer 100 connects to a local network via a network interface or adapter 29, e.g., supporting Ethernet or like network communications protocols. When implemented in a wide area network (WAN) networking environment, the computer 100 may connect to a WAN 300 via a high speed cable/dsl modem 180 or some other connection means. The cable/dsl modem 180 can be located internal or external to computer 100, and can be connected to the bus 101 via the S/O interfaces 145 or other appropriate coupling mechanism. Although not illustrated, the computing environment 100 can provide wireless communication functionality for connecting computer 100 with other networked remote devices (e.g., via modulated radio signals, modulated infrared signals, etc.).

In the networked environment, it is understood that the computer system 100 can draw from program modules stored in a remote memory storage devices (not shown) in a distributed configuration. However, wherever physically stored, one or more of the application programs executing the blind change detection for audio segmentation system of the invention can include various modules for performing principal tasks. For instance, the application program can provide logic enabling input of audio source data for storage as media files in a centralized data storage system and/or performing the audio segmentation techniques thereon. Other program modules can be used to implement additional functionality not specifically identified here.

The present invention has been described with reference to flow diagrams and/or block diagrams of methods, apparatus (systems) and computer program products according to embodiments of the invention. It will be understood that each flow and/or block of the flow diagrams and/or block diagrams, and combinations of flows and/or blocks in the flow diagrams and/or block diagrams, can be implemented by computer program instructions. These computer program instructions may be provided to a processor of a general purpose computer, special purpose computer, embedded processor or other programmable data processing apparatus to produce a machine, such that the instructions, which execute via the processor of the computer or other programmable data processing apparatus, create means for implementing the functions specified in the flow diagram flow or flows and/or block diagram block or blocks.

These computer program instructions may also be stored in a computer-readable memory that can direct a computer or other programmable data processing apparatus to function in a particular manner, such that the instructions stored in the computer-readable memory produce an article of manufacture including instruction means which implement the function specified in the flow diagram flow or flows and/or block diagram block or blocks.

The computer program instructions may also be loaded onto a computer-readable or other programmable data processing apparatus to cause a series of operational steps to be performed on the computer or other programmable apparatus to produce a computer implemented process such that the instructions which execute on the computer or other programmable apparatus provide steps for implementing the functions specified in the flow diagram flow or flows and/or block diagram block or blocks.

While it is apparent that the invention herein disclosed is well calculated to fulfill the objects stated above, it will be appreciated that numerous modifications and embodiments may be devised by those skilled in the art and it is intended that the appended claims cover all such modifications and embodiments as fall within the true spirit and scope of the present invention.

Having thus described our invention, what we claim as new, and desire to secure by Letters Patent is:

1. A computer-implemented method for blind change detection of audio segments comprising:

receiving an input audio stream to be segmented;

applying two or more change detection audio segmentation processes to said input audio stream and obtaining a set of candidate change points from each;

combining said sets of candidate change points of each said applied processes for audio segmentation change detection;

calculating values of measurements of each said two or more change detection audio segmentation processes at every candidate change point of the combined sets; and, removing invalid candidate change points based on said calculated values to thereby optimize valid audio segmentation change points of the audio stream, wherein a programmed processor device performs said applying, combining, calculating and removing.

2. The method as claimed in claim 1, wherein said removing includes applying a voting scheme to determine valid candidate change points.

3. The method as claimed in claim 1, wherein said removing includes applying a likelihood ratio test to determine valid candidate change points.

4. The method as claimed in claim 1, wherein candidate change points are combined in like segments of said audio stream as a result of said applying.

5. The method as claimed in claim 1, further comprising recording a start time for each remaining change point in the audio stream, said recording comprising:

for each segment, determining whether a candidate change point exists, and recording a corresponding start time.

6. The method as claimed in claim 5, wherein a segment is of a predetermined time duration, said method further comprising:

determining whether a multiple number of audio segments have elapsed since recording a last start time of a change point, and advancing a start time commensurate with said multiple number of audio segments elapsed.

7. The method as claimed in claim 1, wherein a change detection audio segmentation process comprises a Bayesian Information Criterion (BIC) change detection test.

8. The method as claimed in claim 1, wherein a change detection audio segmentation process comprises a CuSum algorithm change detection test.

9. The method as claimed in claim 1, wherein a change detection audio segmentation process comprises a Kolmogorov-Smirnov change detection test.

10. A system for implementing blind change detection of audio segments comprising:

a memory;

a processor in communications with the memory, wherein the system performs a method comprising:

receiving an input audio stream to be segmented;

applying two or more change detection audio segmentation processes to said input audio stream and obtaining a set of candidate change points from each;

combining said sets of candidate change points of each said applied processes for audio segmentation change detection;

calculating values of measurements of each said two or more change detection audio segmentation processes at every candidate change point of the combined sets; and, removing invalid candidate change points based on said calculated values to thereby optimize valid audio segmentation change points of the audio stream.

11. The system as claimed in claim 10, wherein said removing comprises applying a voting scheme to determine valid candidate change points.

12. The system as claimed in claim 10, wherein said removing comprises applying a likelihood ratio test to determine valid candidate change points.

13. The system as claimed in claim 10, wherein said combining combines candidate change points in like segments of said audio stream after said obtaining.

14. The system as claimed in claim 10, further comprising recording a start time for each remaining change point in the audio stream, said recording including determining, for each segment, whether a candidate change point exists, and recording a corresponding start time.

15. The system as claimed in claim 14, wherein a segment is of a predetermined time duration, said system further comprising:

determining whether a multiple number of audio segments have elapsed since recording a last start time of a change point, and advancing a start time commensurate with said multiple number of audio segments elapsed.

16. The system as claimed in claim 10, wherein said applying comprises one or more of: a Bayesian Information Criterion (BIC) change detection test, a CuSum algorithm change detection test, or a Kolmogorov-Smirnov change detection test.

17. A computer program product comprising a non-transitory computer usable medium readable by a processing circuit and having a computer usable program code for execution by the processing circuit for performing a method of blind change detection of audio segments, said computer program product comprising:

computer readable program code for receiving an input audio stream to be segmented;

computer readable program code for applying at least two change detection audio segmentation processes to said input audio stream and obtaining a set of candidate change points from each;

computer readable program code for combining said sets of candidate change points of each said applied processes for audio segmentation change detection;

computer readable program code for calculating values of measurements of each said two or more change detection audio segmentation processes at every candidate change point of the combined sets; and, computer readable program code for removing invalid candidate change points based on said calculated values to thereby optimize valid audio segmentation change points of the audio stream.

18. The computer program product as claimed in claim 17, wherein said removing includes applying one of: a voting scheme to determine valid candidate change points or a likelihood ratio test to determine valid candidate change points.

19. The computer program product as claimed in claim 17, wherein said means for applying comprises one or more of: a Bayesian Information Criterion (BIC) change detection test, a CuSum algorithm change detection test, or a Kolmogorov-Smirnov change detection test.

20. The computer program product as claimed in claim 17, further comprising computer readable program code for recording a start time for each remaining change point in the audio stream, said recording comprising:

for each segment, determining whether a candidate change point exists, and recording a corresponding start time.

* * * * *